US010273746B1

(12) United States Patent
O'Keeffe

(10) Patent No.: US 10,273,746 B1
(45) Date of Patent: Apr. 30, 2019

(54) FIRE RATED DOOR

(71) Applicant: William F. O'Keeffe, Brisbane, CA (US)

(72) Inventor: William F. O'Keeffe, Brisbane, CA (US)

( * ) Notice: Subject to any disclaimer, the term of this patent is extended or adjusted under 35 U.S.C. 154(b) by 0 days.

(21) Appl. No.: 15/872,703

(22) Filed: Jan. 16, 2018

(51) Int. Cl.

| | |
|---|---|
| ***E06B 5/16*** | (2006.01) |
| ***E06B 3/58*** | (2006.01) |
| *E06B 3/60* | (2006.01) |
| *E06B 3/70* | (2006.01) |
| *A62C 2/06* | (2006.01) |

(52) U.S. Cl.
CPC ..... *E06B 5/164* (2013.01); *E06B 5/162* (2013.01); *A62C 2/06* (2013.01); *E06B 3/5892* (2013.01); *E06B 3/605* (2013.01); *E06B 2003/7078* (2013.01)

(58) Field of Classification Search
CPC . E06B 5/16; E06B 5/161; E06B 5/162; E06B 5/164; E06B 2003/7078
See application file for complete search history.

(56) References Cited

U.S. PATENT DOCUMENTS

| | | | | |
|---|---|---|---|---|
| 4,164,108 A * | 8/1979 | Ortmanns | E06B 5/165 | 52/232 |
| 4,550,542 A * | 11/1985 | La See | E06B 3/5885 | 52/455 |
| 4,601,143 A * | 7/1986 | O'Keefe | E06B 5/162 | 52/171.3 |
| 4,888,918 A * | 12/1989 | Green | E06B 5/16 | 49/501 |
| 5,644,874 A * | 7/1997 | McKann | E06B 3/5885 | 49/501 |
| 2018/0038157 A1* | 2/2018 | Matsuo | E06B 3/70 | |

FOREIGN PATENT DOCUMENTS

| | | |
|---|---|---|
| DE | 2914467 A1 * | 10/1980 |
| DE | 4321539 A1 * | 1/1995 |

* cited by examiner

*Primary Examiner* — Robert Canfield
(74) *Attorney, Agent, or Firm* — Theodore J. Bielen, Jr.

(57) ABSTRACT

A fire rated door utilizing a pair of frame members each having cases forming opposing open chambers. The open chambers are filled with fire resistant material and include structural plates that do not contact the cases. Holders attach to the cases support a fire resistant glazing unit. The fire rated door may be clad around the pair of frame members.

10 Claims, 6 Drawing Sheets

FIRE RATED DOOR

CROSS-REFERENCES TO RELATED APPLICATIONS

The present application is a Continuation-In-Part of United States Patent Application bearing application Ser. No. 15/601,824, filed 22 May 2017, now issued as U.S. Pat. No. 9,909,356, issued on Mar. 6, 2018.

BACKGROUND OF THE INVENTION

A fire door is generally a door with a fire-resistance rating. Fire rated doors and frames are necessary to keep persons safe and to minimize property damage during a fire. In particular, fire doors are used as part of a passive fire protection system to reduce the spread of fires and smoke between separate compartments of a structure and to allow persons within such structure to egress safely from a building or other structures such as a ship.

Many components of a door assembly must be fire rated to withstand fire for a specified period of time to achieve a fire rating. Such components include, door frames, window frames, hardware, transoms, sidelights, and glazing. For example, reference is made to U.S. Pat. No. 5,910,620 which describes a fire rated glass and method for making the same. In addition, a fire resistive glazing, sold under the designation Superlite II-XL, distributed by O'Keeffe's Inc. of Brisbane, Calif., is capable of obtaining a 60, 90, or 120 minute rating ASTM E119 rating. As heretofore described, it is important that the door frame also meet the guidelines of a particular testing agency to provide a fire rating for the doorset.

A fire door having an economically assembled door frame and fire rated glazing in the formation of a fire rated doorset would be a notable advance in the field of fire resistant building components.

SUMMARY OF THE INVENTION

In accordance with the present invention, a novel and useful fire door is herein provided.

The door of the present invention utilizes a vision panel, window, or lite that is fire rated. In addition, the fire or fire rated door of the present application also includes a frame member which is constructed with a first case or housing, which may be in the general shape of a "clamshell". The case also possesses a sheet or segment portion and first and second legs that extend from the sheet portion in an orientation which is different than the orientation of the sheet portion. In any case, the sheet portion and the first and second legs form an open chamber. Likewise, a second case in employed and is similarly constructed to the first case by having a sheet portion and a pair of extending legs to form an open second chamber.

At least one plate lies across the first and second open chambers of the pair of cases without contacting either the first or second cases. The plates may be formed of metallic material and, lacking contact with the first and second cases, are not conducting heat across the first and second cases. Moreover, a plurality of structured plates may lie across the first and second open chambers of the opposing cases. A fastener is used to fix the first and second cases to the one plate. Such fastener would preferably penetrate a leg of the first or second case. Moreover, a plurality of such fasteners may be used to hold the first and second legs of the first and second cases to one or more plates lying across the first and second chambers formed by the first and second cases.

A fire resistant filler is also positioned in the first and second chambers and may take the form of gypsum or like material. Such fire resistant filler may be in the form of loose material or material formed into a preformed piece or into multiple preformed pieces.

A holder is also used in the device of the present application and is placed adjacent the first and second cases. The holder is formed or fashioned to provide a recess that is capable of being occupied by the vision panel. A connector fastens the holder to the first and second cases to allow the vision panel to extent outwardly from the one frame member. In addition, a second frame member having a holder is employed to capture the vision panel apart from the first frame member. The second frame member may have a similar structure to the first frame member. Door hardware may be attached to the one frame member while a hinge may be attached to the another frame member to permit operation of the fire or fire rated door of the present application.

Moreover, the fire rated door of the present application further possesses a fire resistant filler unit positioned in the first and second open chambers formed by the first and second housings or cases. Such filler unit further provides a non-heat conductive mass between the opposing cases or housings. In addition, the filler unit is fashioned with a passageway for conduits such as electrical and control wires.

It may be apparent that a novel and useful fire door has been hereinabove described.

It is therefore an object of the present application to provide a fire door device that utilizes a fire rated vision panel and is capable of achieving a fire rating.

Another object of the present application is to provide a fire door device in which the vision panel is of relatively large size compared to fire doors of the prior art.

Another object of the present application is to provide a fire door device that may be assembled without welding components together.

A further object of the present application is to provide a fire door device that includes a style of narrower width than fire doors of the prior art.

Yet another object of the present application is to provide a fire door device which is relatively simple to manufacture and assemble.

Another object of the present application is to provide a fire door device which utilizes standard components and is substantially cheaper to manufacture than fire doors of the prior art.

Yet another object of the present application is to provide a fire door device that is capable of stopping smoke and flame to a high degree.

A further object of the present application is to provide a fire door device which includes a frame portion that may be easily cladded with metallic finishes or finishes utilizing other materials such as wood.

Another object of the present application is to provide a fire rated door apparatus that includes fire resistant material that is adhered to metallic parts without the use of fasteners.

Another object of the present application is to provide a fire-rated door apparatus that utilizes substantially less labor to assemble, resulting in a savings of time and cost.

Another object of the present application is to provide a fire door apparatus that is easily clad during the assembly process.

Yet another object of the present application is to provide a fire rated door apparatus that employs a glass vision panel of substantially larger size than doors of the prior art.

The application present other objects and advantages especially as concerns particular characteristics and features thereof which will become apparent as the specification continues.

For a better understanding of the application, reference is made to the following detailed description of the preferred embodiments thereof which should be taken in conjunction with the prior described drawings.

DETAILED DESCRIPTION OF THE PREFERRED EMBODIMENTS

Various aspects of the present application will evolve from the following detailed description of the preferred embodiments which should be referenced to the prior delineated drawings.

Figure 2:
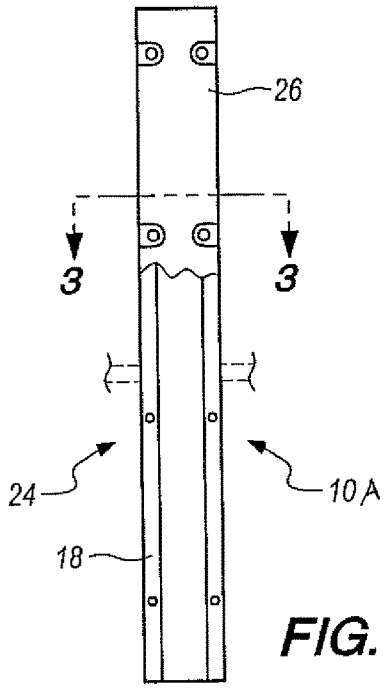
FIG. 2 is a right side view of the door depicted in FIG. 1.

The invention as a whole is shown in the drawings by reference character 10, with embodiments being identified with an additional upper case letter. Fire door 10A includes as one of it elements a vision panel 12, which may also be referred to as a lite, window, and the like. Vision panel 12 is formed of a fire rated glazing unit such as a Superlite II-XL 90, available from O'Keeffe's Inc. of Brisbane, Calif. Fire door 10A also includes a fire rated frame 14 consisting of frame members 16, 18, 20, and 22. Such frame members are similarly constructed. With reference to FIG. 2, it may be observed that end 24 of door 10A is cladded or covered with a closure 25 which may take the form of a stainless steel closure stretch-out. The remaining components of frame member 16 will be discussed hereinafter in detail in FIGS. 3 and 4.

Figure 3:
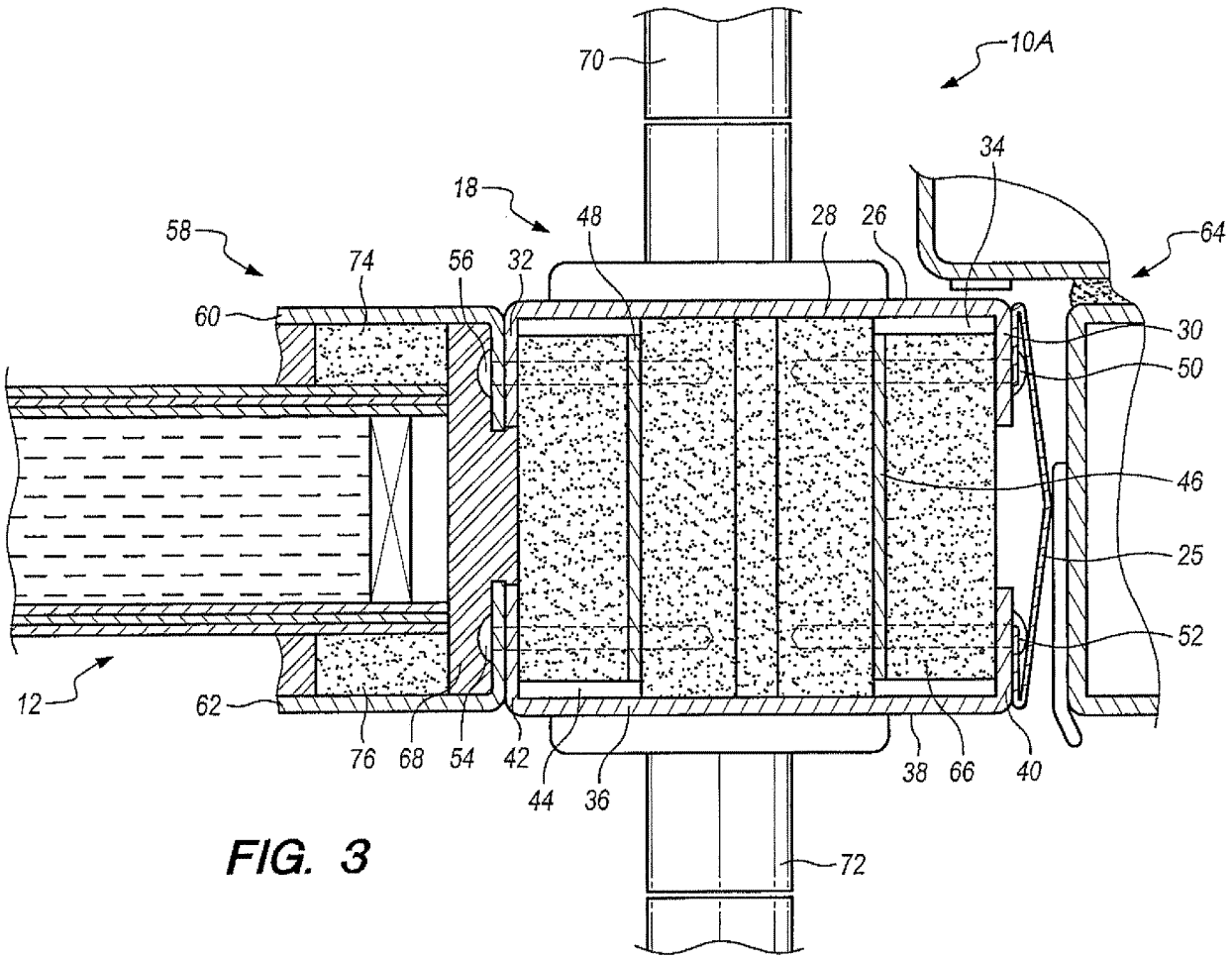
FIG. 3 is a sectional view taken along line 3-3 of FIG. 2.

Turning to FIG. 3, it should be seen that frame member 18 is depicted in section to reveal construction details. Frame member 18 includes a case 26 that is formed with a sheet portion 28 and a pair of legs 30 and 32, angularly extending from sheet portion 28. Legs 30 and 32 are depicted in FIG. 3 as being straight. However, legs 30 and 32 may take other forms such as curved or multi-angled members. Sheet portion 28 and legs 30 and 32 form an open chamber 34.

A second case 36 is also employed in frame member 18 of fire door 10A. Second case 36 includes a sheet portion 38 with extending legs 40 and 42. Again, sheet portion 48 and legs 40 and 42 form an open chamber 44. Open chambers 34 and 36 face one another. Metallic plates 46 and 48 lie across open chambers 34 and 44 without contacting cases 26 and 36. Thus, metallic plates 46 and 48 provide part of the structure of frame member 18 without conducting any heat between cases 26 and 36.

Fasteners 50, 52, 54, and 56 fix cases 26 and 36 to plates 46 and 48. Specifically, exemplar fastener 50 extends through leg 30 of case 26 and plate 46. The remaining fasteners 52, 54, and 56 are similarly positioned.

A holder 58 in the form of a pair of angles 60 and 62 are held to legs 32 of case 26 and leg 42 of case 36 by fasteners 56 and 54, respectively. Holder 58 encloses visual panel 12 to allow extension of the same to frame member 16, which will be discussed in detail as the specification continues. In addition, closure 25 is held to cases 26 and 36 by fasteners 50 and 52. Closure 25 extends to building fire barrier jamb components 64.

A fire resistant filler material 66 is positioned or placed between cases 26 and 36 and generally occupies open chambers 34 and 44. Filler material 66 may take the form of a plurality of gypsum board elements or similar fire resistant material. Strip 68 lies against angles 60 and 62 as well as vision panel 12. Strip 68 may be formed of a silicone material such as that known as 795 Dow Corning. Handles 70 and 72 attach to cases 26 and 36, respectively, to allow operation of door 10A relative to jamb components 64. Fire barriers 74 and 76 lie between angles 60 and 62 and vision panel 12. Fire barriers may take the form of a combination of gypsum material and fire resistant silicone.

Figure 4:
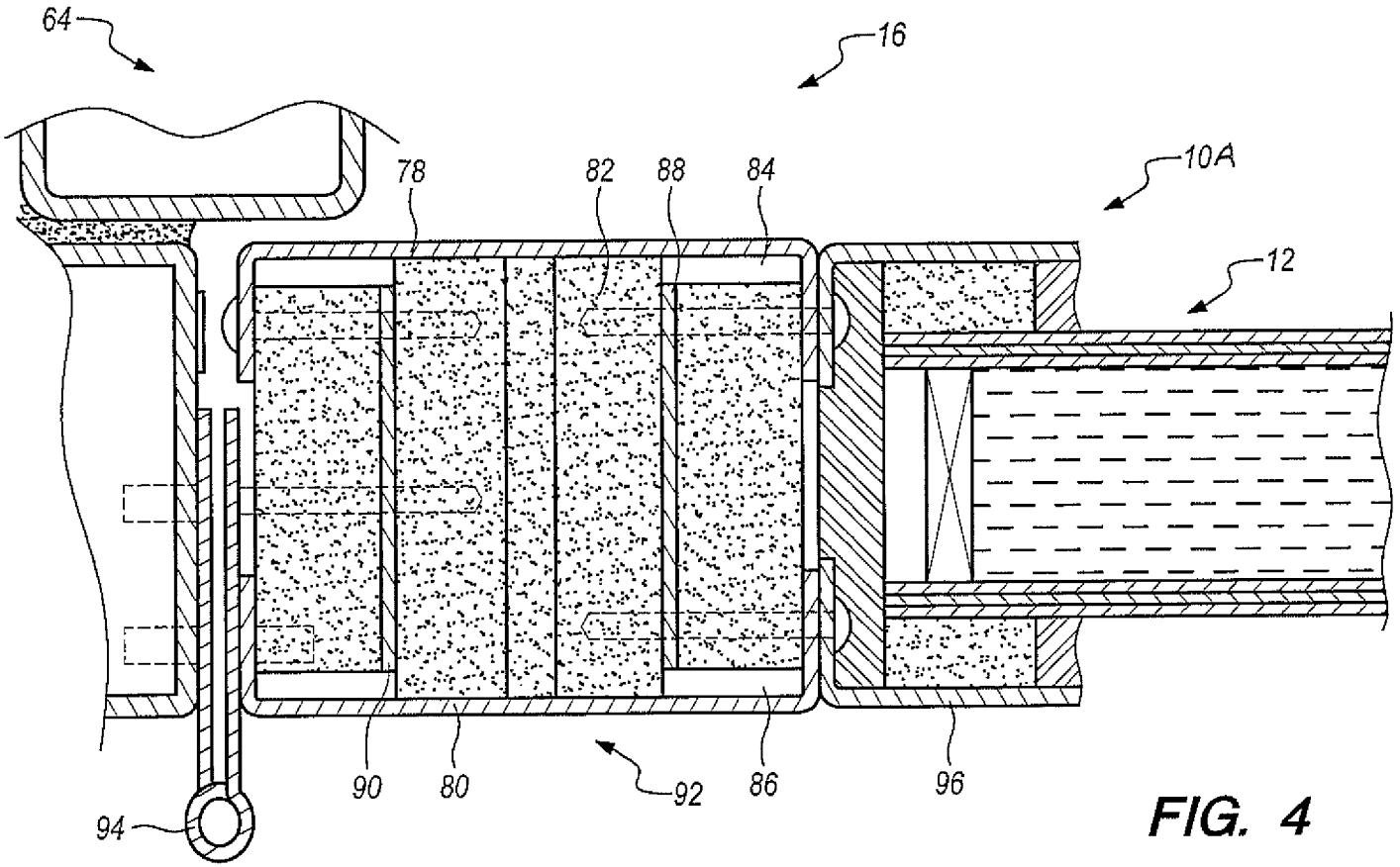
FIG. 4 is a sectional view taken along line 4-4 of FIG. 1.

Turning now to FIG. 4, it may be apparent that frame member 16 is depicted. Frame member 16 is similarly constructed to frame member 18 and includes cases 78 and 80 which are similar to cases 26 and 36 of frame member 18. Filler material 82 lies within open chambers 84 and 86. Structural plates 88 and 90 are held to cases 78 and 80 by plurality of fasteners 92. Again, plates 88 and 90 do not touch cases 78 and 80 in order to prevent thermal conduction therebetween. A hinge 94 is held to case 80 and jamb components 64 to allow the swinging of door 10 once the user operates handle 70 or 72, FIG. 3. The remaining components of frame member 16 are essentially identical to components shown on frame member 18 and will not be discussed further.

Figure 1:
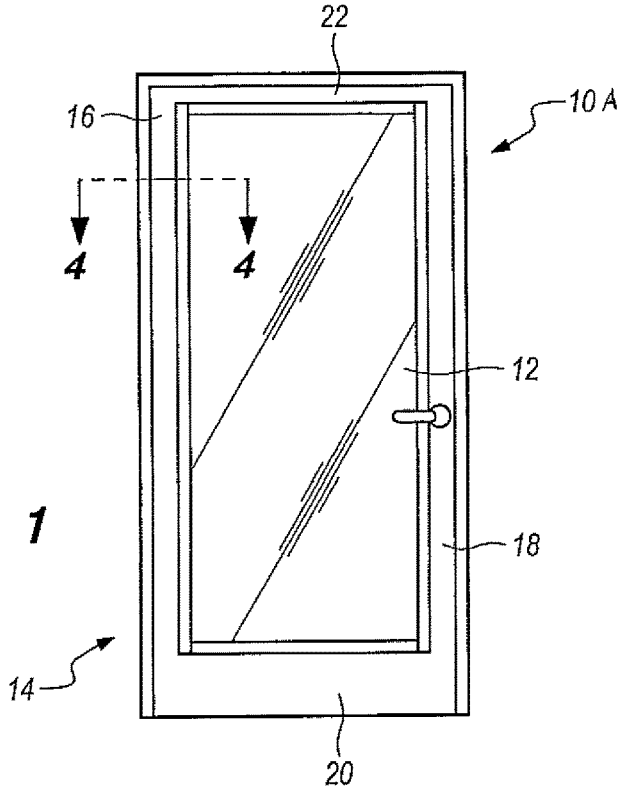
FIG. 1 is a front elevational view of a first embodiment of the door device of the present invention.
Figure 5:
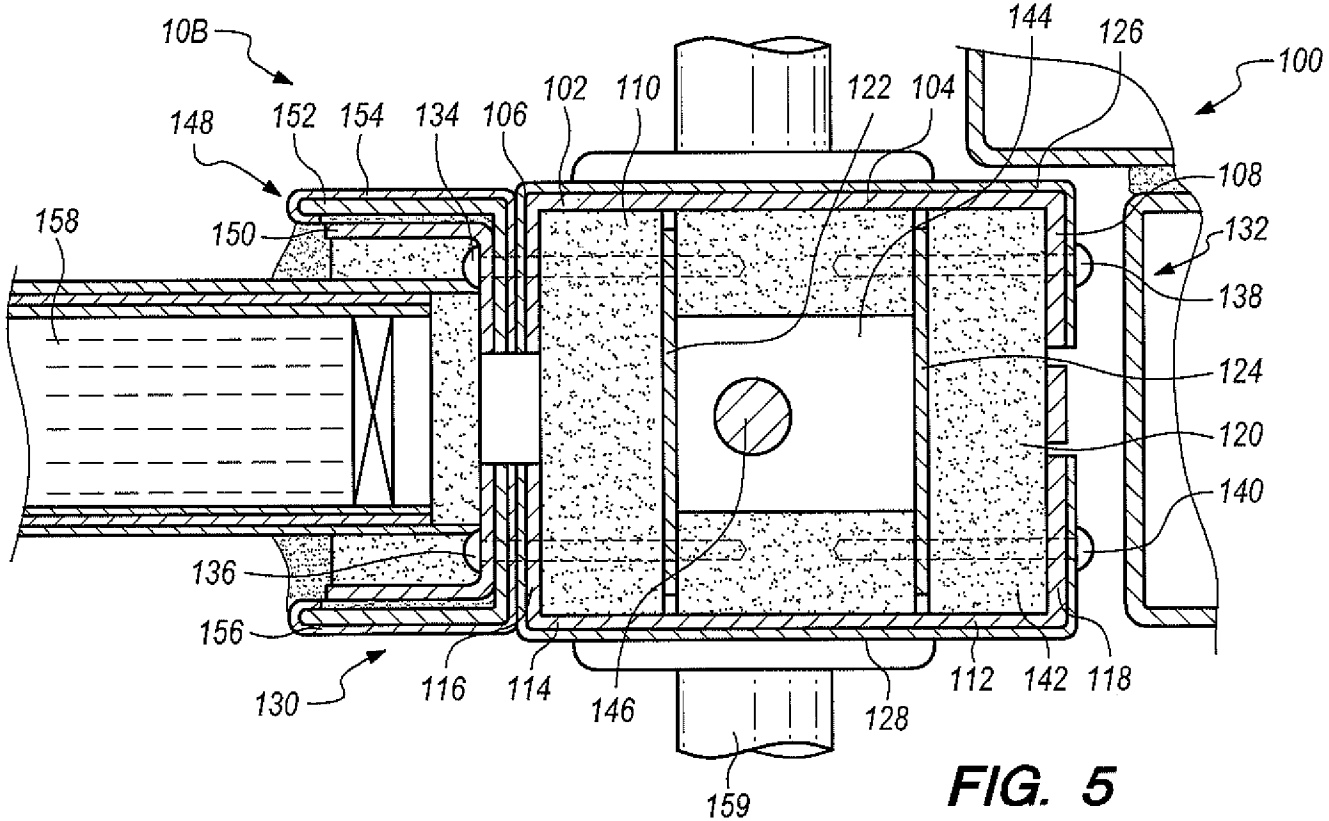
FIG. 5 is a sectional view of a second embodiment of the fire rated door apparatus of the present application corresponding to the right side section line 3-3 of the door shown in FIG. 2.
Figure 6:
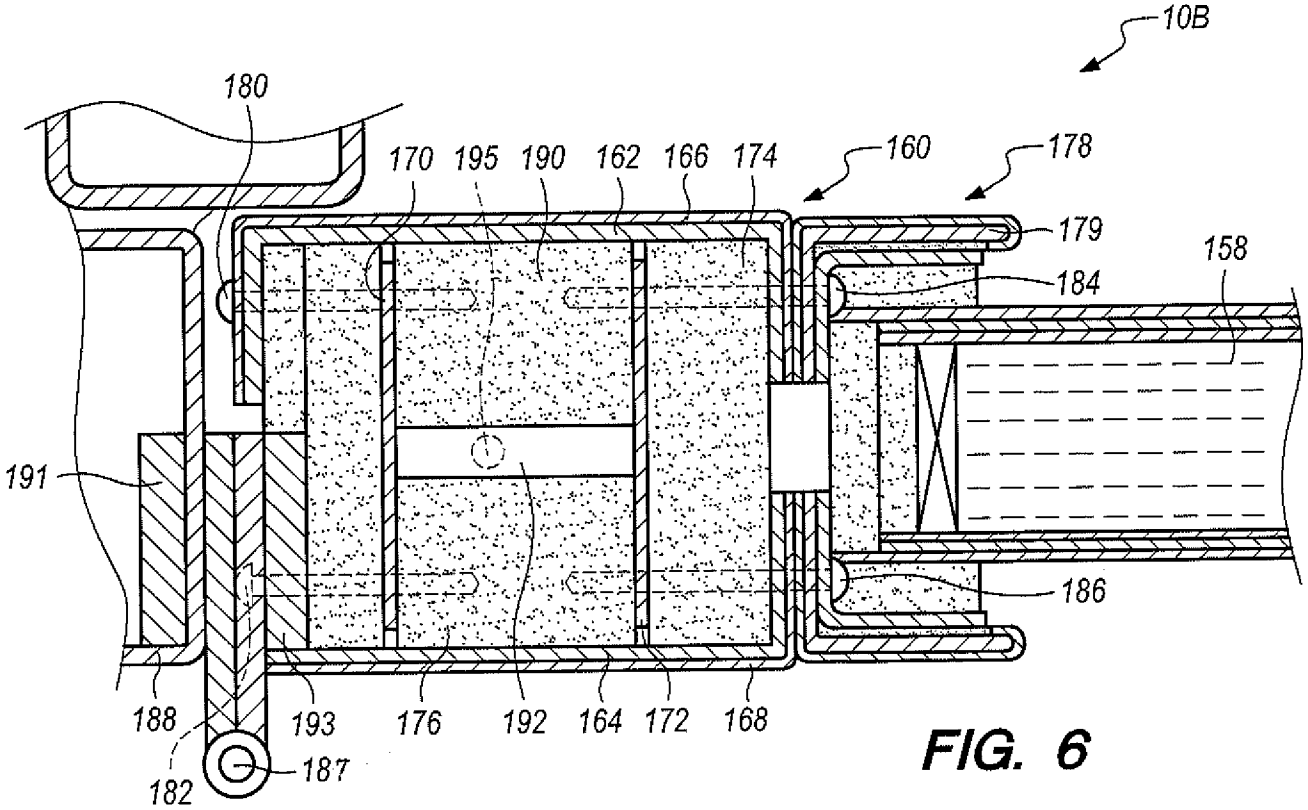
FIG. 6 is a sectional view of the second embodiment of the rated door apparatus of the present application corresponding to the left side section of line 4-4 of the door shown in FIG. 1.

Viewing now FIGS. 5-8, another embodiment 10B of the present application is shown in the form of a fire rated door. FIG. 5 represents the right side of the door analogous to section 3-3 of FIG. 2 with respect to door embodiment 10A. Likewise, FIG. 6 represents a frame member of door embodiment 10B analogous to section 4-4 of FIG. 1 with respect to embodiment 10A. Returning to FIG. 5, it may be observed that frame member 100 is shown. Frame member 100 includes a case or housing 102 formed with a sheet or segment 104 and legs 106 and 108. Housing 102, thus, contains an open chamber 110. A second housing 112 is also included in frame member 100 of embodiment 10B and is formed by a segment 114 with connected legs 116 and 118. Consequently, a second open chamber 120 is formed from second housing 112 and opposes first open chamber 110 of first housing 102. First and second plates 122 and 124 extend across open chambers 110 and 120. Plates 122 and 124 may be metallic members. Again, most importantly, plates 122 and 124 do not contact housings 102 and 112 which may also be formed of metallic material. As a result, there is no thermal conduction between housings 102 and 112 along plates 122 and 124.

Again referring to FIG. 5, cladding layers 126 and 128 overly housings 102 and 112, respectively. Again, cladding layers 126 and 128 may comprise metallic elements having an aesthetic or utilitarian purpose. Cladding layers 126 and 128 conform to the outer configuration of housings 102 and 112 which are generally cup-shaped in cross-sectional configuration.

Fastening device 130 holds overlying cladding layer 126 and housing 102, as well as housing 112 and overlying cladding 128 to plate 122. Fastening device 130 may take the form of modified truss heads self-drilling screws 134 and 136. Also, fastening device 132 holds housing 102 and overlying cladding layer 126, as well as housing 112 and overlying cladding layer 128 to plate 124. Similarly, fastening device 132 may take the form of truss head self-drilling screws 138 and 140. It should be noted that fastening devices 130 and 132 may incarnate into other fastening items such as straps or staples, as long as there is no thermal connection between housings 102 and 112 overlain by cladding layers 126 and 128, respectively.

Moreover, a fire resistant filler unit 142 is positioned in first and second open chambers 110 and 120, details of which will be discussed as the specification continues. It should be realized that fire resistant filler unit 142 provides a passageway 144 through frame 100 which may be used for electrical or signal conduits exemplified by conduit 146.

Frame member 100 is also constructed with a holder 148 formed by a pair of metallic nested angles 150 and 152. Cladding layers 154 and 156 overly nested angles 152 and 154. It should be realized that fasteners 134 and 136 connect holder 148 to housings 102 and 112, respectively. Vision panel 158, similar to vision panel 12 of FIG. 3, lies within holder 148. Intumescent and other fire resistant materials are depicted on FIG. 5 around vision panel 158 in a manner akin to that depicted on FIG. 3 with respect to vision panel 12. Conventional handle 159 also connects to frame member 100.

FIG. 6 shows another frame member 160 forming a portion of fire rated door apparatus 10B. Frame member 160 includes housings 162 and 164 with overlying cladding layers 166 and 168, respectively. Again, plates 170 and 172 span chambers 174 and 176 formed by housings 162 and 164 without touching housings 162 and 164. Holder 178, having recess 179, similar to holder 148 of FIG. 5, supports vision panel 158 there within. Vision panel 158 depicted in FIG. 6, in part, is a continuation of the rendition of vision panel 158 of FIG. 5. Again, fasteners 180 and 182 hold cladded housings 162 and 164 to plate 170. Fasteners 184 and 186, on the other hand, fix holder 178, cladding layers 166 and 168, housing 162, and housing 164 to plate 172. Frame member 160 further includes a hinge 187 which is held to frame member 160 and building structure element 188 via plates 191 and 193 through conventional fasteners (not shown). Fire resistant filler unit 190 is also shown within chambers 174 and 176 and includes passageway 192 to accommodate conduit 195, shown in phantom.

Figure 7:
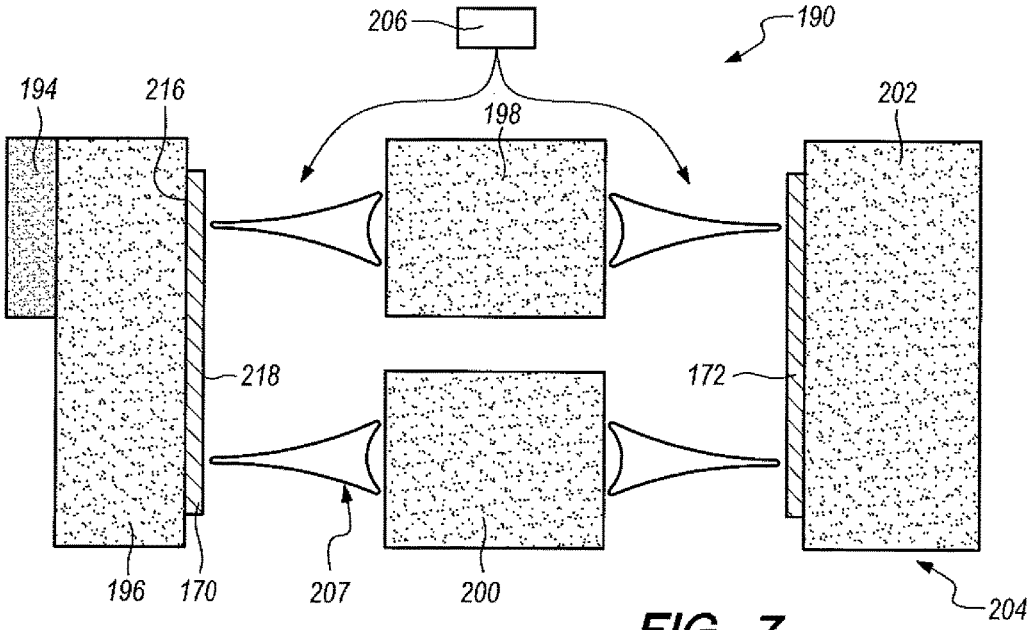
FIG. 7 is an exploded plan view of the fire resistant filler unit used in the second embodiment of the fire rated door of FIGS. 5 and 6.
Figure 8:
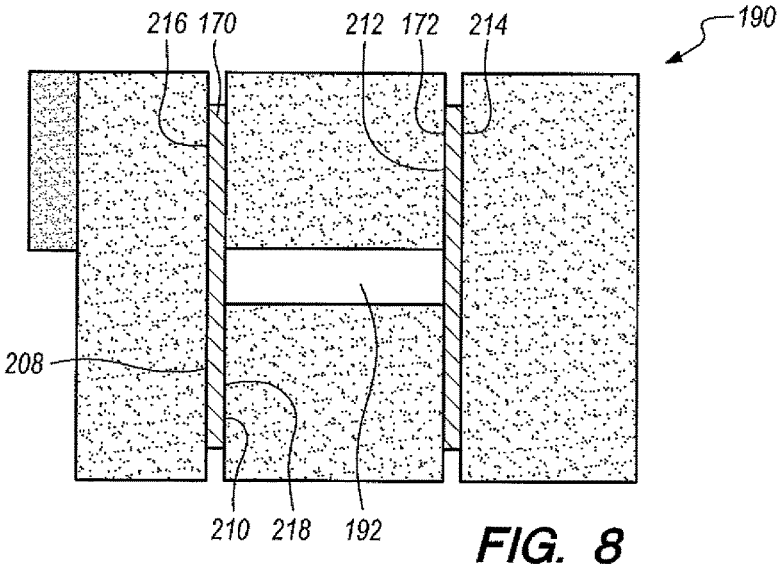
FIG. 8 is a plan view of the fire resistant filler unit of FIG. 7 in its assembled configuration.

With reference to FIGS. 7 and 8, it may be apparent that fire resistant filler unit or mass 190 is depicted in exploded configuration and in an assembled configuration, respectively. It should be noted that fire resistant filler unit 142 of frame member 100 is similarly constructed. Fire resistant gypsum blocks 194, 196, 198, 200, and 202 form a plurality of gypsum blocks 204. Glue source 206 provides glue between the surfaces of plates 170 and 172 and plurality of gypsum blocks 204. Glue source 206 may take the form of a spray-on glue. Directional arrows 207 indicate the direction of assembly of fire resistant filler unit 190. Thickened lines 208, 210, 212, and 214 represent glue layers between plates 170 and plurality of blocks 204. For example, glue layers 208 and 210 adhere to surfaces 216 and 218 of plate 170. Plate 172 is similarly affixed.

In operation, the user assembles door 10A using frame members 16 and 18. Exemplar frame 18 employs cases 26 and 36 to hold fire resistant filler material 66 therebetween, spanning chambers 34 and 44. Structural plates 46 and 48 lie within open chambers 34 and 44 and are held therewithin by plurality of fasteners 50, 52, 54, and 56. Most importantly, plates 46 and 48 do not touch cases 26 and 36 in this assemblage. Fasteners 56 and 62 also supports a holder 58 which captures vision panel 12. Vision panel 12 extends to frame member 16, FIG. 4 and is supported by holder 96 thereof. Holder 96 is fastened to cases 78 and 80 by plurality of fasteners 92. A hinge 94, FIG. 4, is fixed to jamb components 64 and to case 80 which allows door 10 to swing once handle 70 or 72 is operated to release door 10A from jamb component 64, FIG. 3.

Door apparatus 10B is similarly assembled and constructed to door device 10A, with the added steps of placement of conduits 146 and 194 within passageways 144 and 192 of frame members 100 and 160, respectively.

While in the foregoing embodiments of the invention have been set forth in considerable detail for the purpose of making a complete disclosure of the invention it may be apparent to those of skills in the art that numerous changes may be made in such details without departing from the spirit and principles of the invention.

What is claimed is:

1. A fire rated door apparatus having a vision panel, comprising:

one frame member, said one frame member comprising a first housing, said first housing including a segment and first and second legs angularly connected to said segment, said segment and said first and second legs of said first housing forming a first open chamber, and a second housing, said second housing including a segment and first and second legs connected to said segment, said segment and said first and second legs of said second housing forming a second open chamber;

one plate lying across said first and second open chambers without contacting said first and second housings;

a first fastener for fixing said first housing to said one plate and a second fastener for fixing said second housing to said one plate;

a fire resistant filler unit positioned in said first and second open chambers, said fire resistant filler unit lying adjacent said one plate, said fire resistant filler unit providing a passageway;

one holder, said one holder providing a recess, the vision panel at least partially occupying said recess of said one holder; and said first and second fasteners connecting said one holder to said first and second housings.

2. The apparatus of claim 1 in which said one plate includes a first surface and an opposite second surface, and said filler unit comprises a first portion interposed said first surface of said one plate and said first and second housings, a second portion positioned adjacent said second surface of said one plate and said first housing, and a third portion positioned adjacent said second surface of said one plate and said second housing, said second and third portions of said filler unit being spaced from one another to form said passageway.

3. The apparatus of claim 1 which additionally comprises another plate lying across said first and second open chambers without contacting said first and second housings, and third and fourth fasteners for fixing said first and second housings, respectively, to said another plate.

4. The apparatus of claim 1 in which said first and second fasteners are oriented to fix said first legs of said first and second housings, respectively, to said one plate.

5. The apparatus of claim 3 in which said third and fourth fasteners are oriented to fix said second legs of said first and second housings, respectively, to said another plate.

6. The apparatus of claim 1 which further comprises a handle, said handle being mounted to said frame member.

7. The apparatus of claim 1 which further comprises one cladding layer at least partially overlying said one frame member, said one fastening device supporting said one cladding layer to said one frame member.

8. The apparatus of claim 1 which further comprises another frame member, said another frame member comprising a third housing, said third housing having a segment and first and second legs connected to said segment, said segment and said first and second legs of said third housing forming a third open chamber, and a fourth housing, said fourth housing having a segment and first and second legs connected to said segment, said segment and said first and second legs of said fourth housing forming a fourth open chamber;

yet another plate lying across said third and fourth open chambers without contacting said third and fourth housings;

fifth and sixth fasteners for fixing said third and fourth housings, respectively, to said yet another plate;

a fire resistant mass positioned in said third and fourth chambers;

another holder, said another holder providing a recess, the vision panel at least partially occupying said recess of said another holder; and said fifth and sixth fasteners fixing said another holder to said third and fourth housings, respectively.

9. The apparatus of claim 8 which further comprises another a cladding layer at least partially overlying said another frame member, said fifth and sixth fasteners supporting said another cladding layer to said another frame member.

10. The apparatus of claim 8 in which said one and another frame members lie apart from one another and sandwich the vision panel therebetween.

* * * * *